US010011915B2

(12) United States Patent
Sundermeier et al.

(10) Patent No.: US 10,011,915 B2
(45) Date of Patent: Jul. 3, 2018

(54) MULTISTAGE PRETREATMENT OF TINPLATE PRIOR TO THE COATING THEREOF WITH LACQUER

(71) Applicant: Henkel AG & Co. KGaA, Duesseldorf (DE)

(72) Inventors: Uta Sundermeier, Leichlingen (DE); Michael Wolpers, Erkrath (DE); Marcel Roth, Dueseldorf (DE); Jurgen Stodt, Neuss (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 352 days.

(21) Appl. No.: 13/943,111

(22) Filed: Jul. 16, 2013

(65) Prior Publication Data

US 2013/0299379 A1 Nov. 14, 2013

Related U.S. Application Data

(63) Continuation of application No. PCT/EP2011/072769, filed on Dec. 14, 2011.

(30) Foreign Application Priority Data

Jan. 18, 2011 (DE) ..... 10 2011 002 837

(51) Int. Cl.

| | |
|---|---|
| ***C23C 28/00*** | (2006.01) |
| ***C25D 11/00*** | (2006.01) |
| ***C25D 11/34*** | (2006.01) |
| ***B65D 85/72*** | (2006.01) |
| ***C23C 28/04*** | (2006.01) |
| *C25D 11/16* | (2006.01) |

(52) U.S. Cl.

CPC ..... *C25D 11/00* (2013.01); *B65D 85/72* (2013.01); *C23C 28/00* (2013.01); *C23C 28/04* (2013.01); *C25D 11/34* (2013.01); *C25D 11/16* (2013.01)

(58) Field of Classification Search

CPC ..... C23C 28/00; C23C 28/04; C25D 9/06; C25D 11/00; C25D 11/34

USPC ..... 205/199

See application file for complete search history.

(56) References Cited

U.S. PATENT DOCUMENTS

| | | | | |
|---|---|---|---|---|
| 2,312,076 | A * | 2/1943 | Cook | C25D 11/34 205/333 |
| 2,687,994 | A * | 8/1954 | Russell | C25D 11/34 205/225 |
| 3,491,001 | A | 1/1970 | Shackleford et al. | |
| 3,616,307 | A * | 10/1971 | Snyder | C25D 11/34 205/225 |
| 3,658,662 | A | 4/1972 | Casson, Jr. et al. | |
| 3,834,999 | A | 9/1974 | Hradcovsky et al. | |
| 4,339,310 | A * | 7/1982 | Oda | C23C 22/07 106/14.12 |
| 4,448,475 | A | 5/1984 | Reznick | |
| 6,174,426 | B1 * | 1/2001 | Osanaiye | C23C 28/00 205/140 |
| 6,361,833 | B1 * | 3/2002 | Nakada | C23C 22/34 148/420 |
| 2002/0054998 | A1 | 5/2002 | Heimann et al. | |
| 2003/0127024 | A1 | 7/2003 | Heiberger et al. | |
| 2003/0209290 | A1 * | 11/2003 | Heimann | C25D 9/08 148/245 |
| 2004/0043161 | A1 | 3/2004 | Sepeur et al. | |
| 2004/0163735 | A1 * | 8/2004 | Matsukawa | C23C 22/34 148/247 |
| 2004/0222105 | A1 | 11/2004 | Heimann et al. | |
| 2005/0194262 | A1 | 9/2005 | Heimann et al. | |
| 2006/0228575 | A1 | 10/2006 | Klos et al. | |
| 2008/0230394 | A1 * | 9/2008 | Inbe | C23C 22/34 205/241 |
| 2008/0280046 | A1 * | 11/2008 | Bryden | C23C 22/34 427/327 |
| 2009/0142589 | A1 * | 6/2009 | Shoji | B32B 15/08 428/336 |
| 2010/0119867 | A1 * | 5/2010 | Date | C23C 22/58 428/633 |
| 2010/0181201 | A1 | 7/2010 | Bibber | |
| 2010/0203355 | A1 * | 8/2010 | Kadowaki | B32B 15/01 428/648 |
| 2013/0276873 | A1 | 10/2013 | Santori et al. | |

FOREIGN PATENT DOCUMENTS

| | | | | |
|---|---|---|---|---|
| CN | 1735715 | A | 2/2006 | |
| CN | 101384753 | A | 3/2009 | |
| EP | 0202870 | A1 | 11/1986 | |
| EP | 0493133 | A2 | 7/1992 | |
| EP | 2143822 | A1 | 1/2010 | |
| EP | 2186928 | A1 | 5/2010 | |
| GB | 479746 | A | 2/1938 | |
| GB | 1483305 | A | 8/1977 | |
| JP | 54068734 | A | 6/1979 | |
| JP | 56150199 | A | 11/1981 | |
| JP | 57070292 | A | 4/1982 | |
| JP | 2000248398 | A | 12/2000 | |
| JP | 2008202094 | A | 4/2008 | |
| WO | 2008123632 | A1 | 10/2008 | |
| WO | WO 2008123632 | A1 * | 10/2008 | C23C 22/58 |

(Continued)

OTHER PUBLICATIONS

Belyanovskaya et al., "Anodic Treatment of Tin in Alkaline Electrolytes," Russian Journal of Applied Chemistry (no month, 2007), vol. 80, No. 1, pp. 74-77.*

(Continued)

*Primary Examiner* — Edna Wong

(74) *Attorney, Agent, or Firm* — Mary K. Cameron

(57) ABSTRACT

The invention relates to a two-stage method for the anti-corrosive pretreatment of tinplate, in which an anti-corrosive primer coating is applied in a first step, in which the tinplate is anodically polarized in an electrolyte containing at least one inert water-soluble salt and is then in a second step, brought in contact with an acidic aqueous composition containing water-soluble inorganic compounds of the elements Zr, Ti, Hf, and/or Si.

26 Claims, No Drawings

(56) References Cited

FOREIGN PATENT DOCUMENTS

| | | | | |
|---|---|---|---|---|
| WO | WO-2008123632 | A1 * | 10/2008 | ..... C23C 22/58 |
| WO | 2010057001 | A2 | 5/2010 | |

OTHER PUBLICATIONS

International Search Report for PCT/EP2011/072769, dated Mar. 12, 2012. All references cited in the International Search Report are listed herein.

International Search Report for PCT/EP2011/072708, dated Mar. 2, 2012, 3 pages. All references cited in the International Search Report are listed herein.

* cited by examiner

MULTISTAGE PRETREATMENT OF TINPLATE PRIOR TO THE COATING THEREOF WITH LACQUER

The present invention relates to a two-stage method for the anti-corrosive pretreatment of tinplate, in which an anti-corrosive primer coating is applied in one step, said primer coating effectively preventing the shiny metal surface of the pretreated tinplate from turning black when the pretreated tinplate of the invention that is provided with a topcoat is in contact with liquids releasing or containing sulfur compounds and with food containing protein. In the method according to the invention, the tinplate is anodically polarized in an electrolyte containing at least one inert water-soluble salt and then brought into contact with an acidic aqueous composition containing water-soluble inorganic compounds of the elements Zr, Ti, Hf, and/or Si. Tinplate pretreated according to the invention can be used in particular for the production of food-safe packaging, such as beverage cans or tin cans.

Tinplate strip is considered in the food industry to be a suitable material for the production of packaging units for liquids or preserved foods since, owing to the electrochemically inert layer of tin, tinplate releases only small quantities of potentially harmful tin salts to the food product in contact with the tin surface, even over a prolonged period of time. Tinplate strip is therefore an important starting product for food packaging in the steel-processing industry, for example for the production of cans for beverages and preserved soup, fish or meat products. For the production of cans, the packaging industry mainly uses tinplate which is already provided with an organic topcoat to minimize the introduction of iron salts, which can enter the product in the event of damage to the protective tin layer and may have a negative effect on the taste of the food. For the preparation of lacquered tinplate strip, it is necessary to pretreat the tin surface, on the one hand to ensure that the lacquer adheres to the metal surface and on the other hand to provide additional protection against creep corrosion under the lacquer. A suitable pretreatment, which is still widespread in the prior art, is the chromating of the tin surface by bringing the tinplate into contact with an acidic aqueous composition containing chromium salts.

In the development of alternative passivation methods, another property of tinplate should be taken into account, which is always important when foods containing protein are to be stored or packed. Small quantities of low molecular weight sulfur compounds are formed as degradation products of proteins which, as soon as they come into contact with the tin surface of the tinplate, cause the once shiny metal surface to turn black. Since the low molecular weight sulfur compounds, for example $H_2S$, can also diffuse through the organic topcoat, even lacquered tinplate turns black. Although not associated with any significant impairment of lacquer adhesion, these discolorations of the internal surfaces of tinplate cans are undesirable for the food industry as they give consumers the impression that the packaged food is inedible.

In the prior art, pretreatments of tinplate are known which encompass the electrochemical modification of the tin surface and subsequent passivation. The aim of these pretreatment methods described in the prior art, apart from providing a suitable primer coating for corrosion protection, is in particular to ensure the natural color retention of the pretreated and lacquered tinplate products on contact with foods which release sulfur compounds.

GB 479,746 already describes the problem of discoloration of the internal surfaces of containers made of tinplate which are in contact with foods containing protein, and proposes applying an anodic current to the tinplate in an ammoniacal electrolyte, making the tin surface insensitive to discolorations by sulfurous compounds. The tinplates that have been anodically oxidized according to GB 479,746 are then provided with an organic topcoat.

In U.S. Pat. No. 3,491,001, a method for the passivation of tinplates is described, in which an anodic pretreatment in an alkaline electrolyte is followed by a cathodic treatment of the tinplate in an alkaline chromate-containing electrolyte. An electrolytic process chain as described in U.S. Pat. No. 3,491,001 protects the tin surface against corrosion and against turning black on contact with foods which release sulfurous compounds. Electrolytic chromium-containing passivation also acts as a primer for subsequently applied organic topcoats.

From U.S. Pat. No. 4,448,475, an anodic pretreatment of tinplate in an acidic aqueous anolyte is known for improving the adhesion of subsequently applied organic topcoats. The method is said to be particularly applicable and useful in the can industry.

EP 0202870 supplements the teaching of U.S. Pat. No. 4,448,475 with those anolytes which contain stannides and/or stannates.

Regardless of the already existing prior art relating to the modification of tin surfaces for preserving the metallic sheen of the internal surfaces of containers made of tinplate in constant contact with food, there is a need to develop the known methods further in terms of their economic viability and efficiency.

An object of the present invention in particular is in pretreating tinplate products for the manufacture of food packaging with the lowest possible loss of tin during pickling in such a way that excellent adhesion of organic topcoats on the tinplate is ensured together with permanent resistance of the pretreated and lacquered tin surfaces to discolorations by sulfidic compounds, establishing the most effective possible passivation of the tin surface for this purpose, by building on the prior art.

This object is achieved in a method for the pretreatment of tinplate prior to lacquering with an organic topcoat, in which in a first step an anodic polarization takes place in an aqueous electrolyte containing at least one inert, water-soluble salt and then, in a second step, a passivation is performed by bringing the tinplate into contact with an acidic aqueous composition containing water-soluble inorganic compounds of the elements Zr, Ti, Hf and/or Si.

According to the invention, tinplate is understood to be all tin-plated or tin alloy-plated steel plates.

Salts which are a constituent of the electrolyte in the method according to the invention are considered to be water-soluble within the meaning of the present invention if their solubility in water at a temperature of 20° C. is at least 50 g/l, based on the respective salt.

Inert water-soluble salts within the meaning of the present invention are water-soluble salts which do not take part in the electrode processes (tinplate, cathode) in aqueous solution, i.e. they are not involved in heterogeneous electron transfer reactions and are used exclusively to transport current. Suitable inert water-soluble salts are, for example, carbonates, phosphates, sulfates, nitrates and hydroxides of alkali metals, which are equally preferred as constituents of the electrolyte in the method according to the invention, whereas halides can also be used but are less suitable because of their corrosiveness towards metal surfaces. Inert salts are contained in the electrolyte of the first step of the method preferably in a quantity such that the specific conductivity of the electrolyte is at least 1 mS/cm.

The anodic polarization in the first step of the method according to the invention preferably takes place at a current density of at least 0.005 $A/dm^2$, particularly preferably of at least 0.1 $A/dm^2$, but preferably no more than 6 $A/dm^2$, particularly preferably no more than 4 $A/dm^2$. Current densities below 0.005 $A/dm^2$ are not capable of suitably modifying the tin surface, i.e. converting mixed oxide present on the surface consisting of tin in the oxidation states +II and +IV into an oxide layer which consists mostly of tin(IV) oxide/hydroxide. Conversely, anodic current densities above 6 $A/dm^2$ are disadvantageous within the meaning of the present invention because at these current densities, owing to the semi-conductive properties of the tin oxide layer, a large part of the quantity of current is applied to the release of oxygen. On the one hand, this release of oxygen causes a marked reduction in pH at the tinplate surface, so that increased corrosive loss of the tin oxide layer results, and on the other hand, because of the intensive release of gas bubbles, non-homogeneous oxide covering layers are formed with local defects which represent a less suitable primer for organic topcoats. As already described, therefore, it is particularly advantageous to set current densities in the range of 0.5 to 4 $A/dm^2$ in the method according to the invention, both to ensure low corrosion of the tin coating and to avoid producing any oxide layers rich in local defects.

The duration of the anodic polarization in the method according to the invention is preferably at least 0.2 seconds, particularly preferably at least one second, since with lower polarization times the tin surface mainly undergoes capacitive charge reversal without the flow of an adequate Faraday current which is capable of chemically modifying the tin surface. A polarization period of more than 300 seconds brings no improvement in the properties of the oxide covering layer as a primer coating, even with low current densities. Instead, as the polarization time increases, the amorphousness of the oxide layer appears to increase owing to constant repassivation of the surface, so that in methods with prolonged polarization, lacquer adhesion deteriorates on tinplates that have been pretreated and passivated in this way.

The type of anodic polarization can be freely selected in the first step of the method according to the invention and can take place for example potentiostatically, potentiodynamically, galvanostatically or galvanodynamically. However, because processability is easier, the galvanostatic application of a current is preferred. A galvanostatic step of the method is therefore also preferred according to the invention since variations in the conductivity of the electrolyte or small changes in the spatial orientation of the tinplate to the cathode have no effect on the electrochemical modification of the tin surface. If the method according to the invention is carried out potentiostatically or potentiodynamically in the first step, the generally preferred current densities should each be regarded as time-averaged current densities.

Carrying out a purse method, in which anodic current or voltage pulses are applied, is also suitable in the first step of the method according to the invention, the individual pulse preferably lasting at least 0.2 seconds and the anodic polarization period overall, i.e. totaled over all of the anodic pulses, preferably not exceeding 300 seconds. During the contact of the tinplate with the electrolyte in the first step of the method according to the invention, cathodic polarization should preferably be avoided. In the first pre-treatment step, the electrolyte is preferably brought into contact with the tinplate for anodic polarization by complete immersion of the tinplate in the electrolyte.

Furthermore, the electrolyte in the first step of the method according to the invention can additionally contain at least one organic dicarboxylic acid with no more than 6 carbon atoms, and/or a water-soluble metal salt thereof, which is preferably selected from succinic acid, malonic acid, oxalic acid, glutaric acid, adipic acid and/or alkali metal salts thereof, and is particularly preferably selected from oxalic acid and/or alkali metal salts thereof. The addition of these dicarboxylic acids to the electrolyte has the effect of providing the tinplate surface in the method according to the invention with increased resistance to discoloration on contact with food containing protein.

The proportion of the organic dicarboxylic acids in the electrolyte of the method according to the invention is preferably in the range of 0.01 to 2 wt. %.

To improve the pretreatment further in terms of lacquer adhesion and retention of natural color when exposed to food containing protein, the electrolyte in the first step of the method according to the invention can additionally contain at least one water-soluble silicate of the composition $M_2O.nSiO_2$, where M is an alkali metal ion or quaternary ammonium ion and n is a natural number between 0.8 and 7. According to the invention, water-soluble silicates are understood to be compounds of the general empirical formula $M_2O.nSiO_2$, with M as an alkali metal ion or quaternary ammonium ion and n as a natural number between 0.8 and 7, which have a solubility of at least 1 g/l based on $SiO_2$ at a pH value of 8 and a temperature of 20° C.

The alkali metal ions M of the water-soluble silicates are preferably selected from Li, Na and K. In addition, quaternary ammonium ions with aliphatic residues having in each case no more than 10 carbon atoms are equally preferred in electrolytes of the method according to the invention.

Suitable water-soluble silicates are in particular the so-called water glasses, which are produced by melting $SiO_2$ with the respective oxide $M_2O$. Preferred are those water glasses in which the proportion of $SiO_2$ is in the range of 20-40 wt. %. Those water glasses in which the molar ratio of $SiO_2$:$M_2O$ is in the range of 2 to 5, in particular in the range of 3 to 4, are particularly preferred.

The presence of at least one water-soluble silicate in the electrolyte of the method according to the invention has the effect that, during the anodic polarization, a thin silicate layer is produced on the tinplate, which provides an improved primer for organic topcoats. At the same time, the tinplate that has been anodically polarized in this electrolyte and then passivated displays no significant blackening on contact with sulfur-containing compounds and the metallic sheen of the coated tinplate surface is almost completely retained over a prolonged period.

In the first step of the method according to the invention, the proportion of water-soluble silicates in the electrolyte is preferably at least 0.1 wt. %, particularly preferably at least 1 wt. %, in particular at least 2 wt. %, but preferably less than 30 wt. %, particularly preferably less than 20 wt. %, based in each case on the proportion of $SiO_2$. Below a proportion of 0.1 wt. %, based on $SiO_2$ in the electrolyte, the coating weight based on the element silicon that can be deposited on the tinplate surfaces during anodic polarization is too low to have an additional positive effect on the adhesion of the subsequently applied organic lacquer system to the tinplate that has been treated according to the invention. From a proportion above 30 wt. %, based on $SiO_2$, high-viscosity electrolytes are obtained which are less suitable for the method according to the invention since the coating weight of $SiO_2$ is increased significantly by the electrolyte film adhering to the tinplate surface, so that the result of the pretreatment is difficult to control and, for example, additional rinsing steps or drying steps are necessary before the organic topcoat can be applied to the pretreated tinplate.

In the first step of the method according to the invention, the pH value of the electrolyte is preferably in a range of 2 to 13, particularly preferably in a range of 3 to 12. In electrolytes with higher alkalinity or higher acidity, the tin layer of the tinplate is corroded. Insofar as the electrolyte additionally contains water-soluble silicates, the preferred pH value is in the range of 8 to 13, particularly preferably in the range of 10 to 12. In electrolytes with a pH value below 8, the water solubility of the silicates decreases sharply and $SiO_2$ is increasingly precipitated.

In the event that the electrolyte in the first step of the method according to the invention additionally contains at least one water-soluble silicate, it is further preferred that at least one organosilane is additionally contained, which itself brings about an improved silicating of the tinplate surfaces and in addition, via a suitable functionality in the non-hydrolyzable organic residue, improves adhesion to organic lacquer systems. In this case, the addition to the electrolyte of those organosilanes having at least one hydrolyzable substituent which is split off under hydrolysis as an alcohol having a boiling point of less than 100° C., and containing at least one non-hydrolyzable substituent, is preferred, this non-hydrolyzable substituent preferably having at least some primary amino functions. Most particularly preferably, the organosilane is selected from compounds of the following general structural formula (I):

$$H_2N—[(CH_2)_mNH]_y(CH_2)_n—Si—X_3 \quad (I)$$

wherein the substituents X, each independently of one another, are selected from alkoxy groups with no more than 4 carbon atoms, wherein m and n, each independently of one another, are integers between 1 and 4 and y is an integer between 0 and 4.

The proportion of the organosilanes in the electrolyte of the first step of the method containing water-soluble silicates is preferably in the range of 0.01 to 5 wt. %.

To support the hydrolytic crosslinking of the organosilanes on the tinplate surface, water-soluble aluminum salts that do not contain any halides can additionally be added to those electrolytes, preferably in a quantity of at least 0.001 wt. %, but preferably no more than 1 wt. % of aluminum salts in total.

The second step of the method according to the invention immediately follows the anodic pretreatment of the first step of the method, with or without an intermediate washing or drying step.

The acidic aqueous composition in the second step of the passivation preferably contains those water-soluble inorganic compounds of the elements Zr, Ti, Hf and/or Si, particularly preferably those compounds of the elements Zr, Ti and/or Si, in particular those compounds of the elements Zr and/or Ti, which are selected from the respective fluoro complex salts, fluoro acids and/or salts of the fluoro acids, particularly preferably selected from the respective fluoro acids and/or salts of the fluoro acids. In a particularly preferred embodiment, the acidic aqueous composition in the second step contains at least one water-soluble inorganic compound of the element titanium, which is preferably selected from the respective fluoro complex salts, fluoro acids and/or salts of the fluoro acids of titanium.

The proportion of the water-soluble inorganic compounds of the elements Zr, Ti, Hf and/or Si in the acidic aqueous composition of the passivation in the second step of the method according to the invention is preferably at feast 0.001 wt. %, particularly preferably at least 0.01 wt. %, but preferably no more than 0.5 wt. %, based on the respective element, it being further preferred if at least 0.001 wt. %, particularly preferably at least 0.01 wt. %, based on the acidic composition, of water-soluble compounds of the element titanium are contained.

In addition, it is preferred if the acidic aqueous composition of the passivation in the second step of the method contains phosphate ions, preferably with a proportion in the acidic aqueous composition of at least 0.01 wt. %, particularly preferably at least 0.1 wt. %, but preferably no more than 3 wt. %, based on $PO_4$.

Furthermore, the acidic aqueous composition for the passivation of the anodically pretreated tinplate in the second step of the method can contain water-soluble and/or water-dispersible organic polymers, such as for example polyacrylates, polyisocyanates, polyepoxides, polyalkylamines, polyalkylene imines or amino-substituted polyvinylphenol derivatives. If the electrolyte in the anodic pretreatment of the tinplate additionally contains amino-functionalized organosilanes, those water-soluble and/or water-dispersible organic polymers that can be further cross-linked in condensation reactions, i.e. polyisocyanates, polyepoxides and/or mixtures thereof, are preferred.

The total proportion of water-soluble and water-dispersible organic polymers in the acidic aqueous composition of the passivation in the second step of the method is preferably in the range of 0.05 to 10 wt. %, particularly preferably in the range of 2 to 5 wt. % in a method according to the invention.

The pH value of the acidic aqueous composition which is brought into contact according to the invention with the anodically pretreated tinplate is preferably in a range of 2.5 to 5.5.

It is further preferred that the passivation of the anodically pretreated tinplate in the second step of the method be performed electrolessly, i.e. without applying a current.

The anodically pretreated tinplate is preferably brought into contact with the acidic aqueous composition in the so-called "dry-in-place" method, in which a wet film of the acidic aqueous composition is applied onto the tinplate surface and is dried immediately after application. Such a method is particularly suitable for methods according to the invention in which tin-plated steel strip material is to be treated.

Preferably, therefore, the acidic aqueous composition in the second step of the method according to the invention is applied by the so-called coil-coating method, where a moving metal strip is coated continuously. The acidic aqueous composition can be applied by various methods which are common in the prior art. For example, applicator rolls can be used which enable the desired wet film thickness to be adjusted directly. Alternatively, the metal strip can be immersed in the acidic aqueous composition or sprayed with the acidic aqueous composition, after which the desired wet film thickness is adjusted with the aid of squeeze rolls.

After application of the acidic aqueous composition in accordance with such a preferred method according to the invention, the coated tinplate is heated to the required drying temperature. The heating of the coated substrate to the preferred required substrate temperature ("peak metal temperature"=PMT) of 120 to 260° C., particularly preferably of 150 to 170° C., can take place in a heated tunnel oven. However, the acidic aqueous composition which was applied for the purpose of passivation in the second step of the method can also be brought to the appropriate drying or crosslinking temperature by infrared radiation, in particular by near infrared radiation.

In the second step of the method according to the invention, it is preferred to produce coating weights of a total of at least 0.3 mg/m$^2$, particularly preferably at least 2 mg/m$^2$, but a total of no more than 30 mg/m$^2$, particularly preferably no more than 20 mg/m$^2$, based on the respective elements Zr, Ti, Hf and/or Si, by bringing into contact with the acidic aqueous composition. If the electrolyte in the first pretreatment step additionally contains water-soluble silicate, the coating weight can be reduced and is preferably at least 0.3 mg/m$^2$, but no more than 20 mg/m$^2$, without the tin surface that has been treated according to the invention losing its good properties as a primer coating.

Insofar as only tinplate strip which comes directly from the electrolytic production process for tin-plated strip material, and which has not yet been oiled for transport purposes or for subsequent forming, is being treated according to the invention, it is not necessary to clean the tinplate surface before carrying out the method according to the invention. However, if the tinplate strip has already been stored and in particular wetted with anti-corrosive oils or forming oils, a cleaning step is necessary in most cases to remove organic contaminants and salt residues before the tinplate can be anodically pretreated according to the invention. Surfactant cleaning agents known in the prior art can be used for this purpose.

In another aspect, the invention relates to the use of tinplate treated by the method according to the invention for the production of packaging, in particular cans, for the storage of foodstuffs.

EXEMPLARY EMBODIMENTS

To illustrate the method according to the invention, cleaned tinplate (tin coating 2.8 g/m$^2$) was first pretreated electrolytically and then rinsed with distilled water, after which a wet film of a passivating agent was applied using a Chemcoater® and dried at 50° C. for 1 min. The corresponding series of tests are listed in Table 1.

The tinplates treated in this way, without a topcoat, were half immersed in a potassium sulfide solution (5 g/l $K_2S$+5 g/l NaOH in water) for 1 min at 90° C., rinsed with water and dried.

The blackening of the tinplates was evaluated optically according to the following scale:

0: no discoloration; metallic sheen

1: individual black discolorations; <10% of the surface

2: speckled black discolorations; <30% of the surface

3: speckled black discolorations; <50% of the surface

4: speckled black discolorations>50% and almost complete loss of metallic sheen

5: speckled black discolorations>50% and complete loss of metallic sheen

The results in terms of black discolorations after contact of the sheets with the potassium sulfide solution ("sulfide test") are listed in Table 2.

TABLE 2

Results of the sulfide test

| Test number | Sulfide test/scale 0-5 |
|---|---|
| E1 | 1 |
| E2 | 0 |
| CE1 | 3 |
| CE2 | 2 |

It can be seen from Table 2 that, in a direct comparison, the method according to the invention which the anodic polarization followed by passivation with an acidic composition containing water-soluble compounds of Zr and Ti gives a significantly better result in terms of resistance of the tinplate surface to black discolorations than a sequence of methods known in the prior art consisting of anodic polarization and subsequent chromating (cf. E1-CE1). In addition, it is clear that anodic polarization in electrolytes containing water glass is particularly advantageous and, in the method according to the invention, produces tinplate surfaces which are completely inert in the sulfide test and display an unchanged metallic sheen.

TABLE 1

Test series for the anodic polarization of tinplate (tin coating weight 2.8 g/m$^2$) and subsequent passivation

| | Anodic polarization | | | |
|---|---|---|---|---|
| Test number | Electrolyte (75 g/l) | Current density/Adm$^{-2}$ | Time/ seconds | Post passivation |
| E1 | $Na_2CO_3$ | 3.5 | 60 | Ti, Zr |
| E2 | Sodium water glass 37/40 | 3.5 | 60 | Ti, Zr |
| CE1 | $Na_2CO_3$ | 3.5 | 60 | Cr(VI) |
| CE2 | Sodium water glass 37/40 | 3.5 | 60 | Cr(VI) |

Ti, Zr: Passivation with 7 wt. % Granodine 1456 ® (Henkel) corresponding to 770 ppm Ti and 500 ppm Zr; Coating weight of titanium: 3 mg/m$^2$ measured by X-ray fluorescence analysis (Axio Advanced, Panalytical), corresponding additionally to approx. 2 mg/m$^2$ coating weight of zirconium
Cr(VI): Chromating (0.12 wt. % $CrO_3$); Coating weight of chromium: 3 mg/m$^2$ measured by X-ray fluorescence analysis (Axio Advanced, Panalytical)

What is claimed is:

1. A method for the pretreatment of tinplate prior to coating with an organic topcoat comprising:

1) in a first step, anodically polarizing a tinplate surface in an aqueous electrolyte containing at least one inert, water-soluble salt thereby producing a modified tinplate surface consisting essentially of tin(IV) oxide/hydroxide, wherein no portion of said inert, water-soluble salt is incorporated into said modified tinplate surface and wherein said tinplate surface is not cathodically polarized in said aqueous electrolyte and wherein the aqueous electrolyte further contains at least one organosilane with at least one hydrolyzable substituent, which is split off under hydrolysis as an alcohol having a boiling point of less than 100° C., and at least one non-hydrolyzable substituent; and then, 2) in a second step, passivating the modified tinplate surface produced in the first step, by contacting the modified tinplate surface with an acidic aqueous composition containing water-soluble inorganic compounds of the elements Zr, Ti, Hf and/or Si.

2. The method according to claim 1, wherein the acidic aqueous composition in the second step contains as the water-soluble inorganic compounds of the elements Zr, Ti, Hf and/or Si, a fluoro acid of at least one of said elements and/or a salt of said fluoro acid.

3. The method according to claim 2, wherein the elements are Zr and/or Ti.

4. The method according to claim 3, wherein the acidic aqueous composition in the second step additionally contains phosphate ions in an amount of at least 0.01 wt. %, but no more than 3 wt. %, based on $PO_4$.

5. The method according to claim 1, wherein the water-soluble inorganic compounds of the elements Zr, Ti, Hf and/or Si in the acidic aqueous composition of the second step are present in an amount in total of at least 0.001 wt. %, but no more than 0.5 wt. %, calculated based on amount of the element Zr, Ti, Hf and/or Si.

6. The method according to claim 1, wherein the acidic aqueous composition in the second step additionally contains water-soluble and/or water-dispersible organic polymers selected from the group consisting of polyacrylates, polyisocyanates, polyepoxides, polyvinylamines, polyalkylene imines and amino-substituted polyvinyl phenol derivatives.

7. The method according to claim 6, wherein the water-soluble and/or water-dispersible organic polymers in the acidic aqueous composition of the second step are present in an amount in total in a range of 0.05 wt. % to 10 wt. %.

8. The method according to claim 1, wherein pH value of the acidic aqueous composition in the second step is in a range of 2.5 to 5.5.

9. The method according to claim 1, wherein in the second step, the passivating of the modified tinplate surface, by contacting the modified tinplate surface with an acidic aqueous composition produces a coating weight of at least 0.3 $mg/m^2$, but no more than 30 $mg/m^2$, based on the elements Zr, Ti, Hf and/or Si, on the modified tinplate surface.

10. The method according to claim 1, wherein the contacting the modified tinplate surface with the acidic aqueous composition in the second step is where a wet film of the acidic aqueous composition is applied onto the modified tinplate surface and the wet film is dried immediately after application.

11. The method according to claim 1, wherein the anodic polarization in the first step takes place for at least 0.2 seconds, but in total no longer than 300 seconds.

12. The method according to claim 1, wherein the anodic polarization in the first step takes place at a current density of at least 0.005 $A/dm^2$, but no more than 6 $A/dm^2$.

13. The method according to claim 1, wherein the electrolyte in the first step further contains organic dicarboxylic acids and/or salts of the organic dicarboxylic acids, said organic dicarboxylic acids having no more than 6 carbon atoms.

14. The method according to claim 1, wherein the at least one inert water-soluble salt is selected from the group consisting of carbonates, sulfates, nitrates and hydroxides of alkali metals.

15. The method according to claim 1, wherein said at least one non-hydrolyzable substituent has at least some primary amino functions.

16. A method for the pretreatment of tinplate prior to coating with an organic topcoat comprising:

1) in a first step, anodically polarizing a tinplate surface in an aqueous electrolyte containing at least one inert, water-soluble salt thereby producing a modified tinplate surface consisting essentially of tin (IV) oxide/hydroxide, wherein no portion of said inert, water-soluble salt is incorporated into said modified tinplate surface and wherein said tinplate surface is not cathodically polarized in said aqueous electrolyte and wherein the aqueous electrolyte further contains at least one organosilane with at least one hydrolyzable substituent, which is split off under hydrolysis as an alcohol having a boiling point of less than 100° C., and at least one non-hydrolyzable substituent, the aqueous electrolyte further containing at least one water-soluble silicate $M_2O.nSiO_2$, wherein M is an alkali metal ion or quaternary ammonium ion and n is a natural number between 0.8 and 7; and
2) after the first step, in a second step, passivating the modified tinplate surface produced in the first step, by contacting the modified tinplate surface with an acidic aqueous composition containing water-soluble inorganic compounds of elements Zr, Ti, Hf and/or Si.

17. The method according to claim 16, wherein said at least one non-hydrolyzable substituent has at least some primary amino functions.

18. The method according to claim 16, wherein the at least one inert water-soluble salt is selected from the group consisting of carbonates, sulfates, nitrates and hydroxides of alkali metals.

19. The method according to claim 16, wherein the electrolyte in the first step further contains organic dicarboxylic acids and/or salts of the organic dicarboxylic acids, said organic dicarboxylic acids having no more than 6 carbon atoms.

20. The method according to claim 16, wherein the water-soluble inorganic compounds of the elements Zr, Ti, Hf and/or Si in the acidic aqueous composition of the second step are present in an amount in total of at least 0.001 wt. %, but no more than 0.5 wt. %, calculated based on amount of the element Zr, Ti, Hf and/or Si.

21. The method according to claim 20, wherein the elements are Zr and/or Ti.

22. The method according to claim 20, wherein the acidic aqueous composition in the second step additionally contains phosphate ions in an amount of at least 0.01 wt. %, but no more than 3 wt. %, based on $PO_4$.

23. The method according to claim 16, wherein the acidic aqueous composition in the second step contains as the water-soluble inorganic compounds of the elements Zr, Ti, Hf and/or Si, a fluoro acid of at least one of said elements and/or a salt of said fluoro acid.

24. The method according to claim 16, wherein the acidic aqueous composition in the second step additionally contains water-soluble and/or water-dispersible organic polymers selected from the group consisting of polyacrylates, polyisocyanates, polyepoxides, polyvinylamines, polyalkylene imines and amino-substituted polyvinyl phenol derivatives present in an amount in total in a range of 0.05 wt. % to 10 wt. %.

25. The method according to claim 16, wherein in the second step, the passivating of the modified tinplate surface, by contacting the modified tinplate surface with an acidic aqueous composition produces a coating weight of at least 0.3 $mg/m^2$, but no more than 30 $mg/m^2$, based on the elements Zr, Ti, Hf and/or Si, on the modified tinplate surface.

26. The method according to claim 16, wherein the anodic polarization in the first step takes place for at least 0.2 seconds, but in total no longer than 300 seconds at a current density of at least 0.005 $A/dm^2$, but no more than 6 $A/dm^2$.

* * * * *